US005371801A

United States Patent [19]

Powers et al.

[11] Patent Number: 5,371,801

[45] Date of Patent: Dec. 6, 1994

[54] ENERGY ABSORPTION APPARATUS

[75] Inventors: James M. Powers, Norwich; Mark B. Moffett, Waterford; Stephen S. Gilardi, Mystic, all of Conn.

[73] Assignee: The United States of America as represented by the Secretary of the Navy, Washington, D.C.

[21] Appl. No.: 31

[22] Filed: Jan. 4, 1993

[51] Int. Cl.[5] ..... G10K 11/16

[52] U.S. Cl. ..... 381/71; 333/213; 333/215

[58] Field of Search ..... 381/71, 94; 333/213, 333/215

[56] References Cited

U.S. PATENT DOCUMENTS

| | | | |
|---|---|---|---|
| 3,602,844 | 8/1971 | Sykes . | |
| 4,158,787 | 6/1979 | Forward | 310/51 |
| 4,383,230 | 5/1983 | Manzolini | 333/214 |
| 4,485,356 | 11/1984 | Fassino | 333/215 |

*Primary Examiner*—Forester W. Isen

*Attorney, Agent, or Firm*—Michael J. McGowan; Prithvi C. Lall; Michael F. Olgo

[57] ABSTRACT

Apparatus for absorbing acoustic energy directed toward a wall. The apparatus includes a piezoelectric layer intermediate the wall and the source of the acoustic energy. Circuitry attached to the output of the transducer compensates blocked and motional capacitances of the transducer so that the output signal generates real current for dissipation in a resistor thereby to minimize any echo reflected from the piezoelectric layer.

16 Claims, 4 Drawing Sheets

ENERGY ABSORPTION APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

This invention generally relates to apparatus for absorbing sound and more specifically to such apparatus that utilizes a piezoelectric anechoic coating.

2. Description of the Prior Art

It often is desirable to influence the acoustic properties of an environment. The following patents, for example, disclose a number of different approaches that have been used for reducing noise levels:

| | | |
|---|---|---|
| 4,473,906 | (1984) | Warnaka et al |
| 4,480,333 | (1984) | Ross |
| 4,677,677 | (1987) | Eriksson |
| 4,712,247 | (1987) | Swarte |

In each of these patents apparatus samples incoming acoustic energy and produces a compensating signal that can be recombined with the acoustic energy. For example, in the Warnaka et al patent a microphone samples noise passing into a duct. An adaptive filter connected to the microphone generates canceling noise at a location "downstream" in the duct thereby to reduce the overall level of noise emanating from the duct. More specifically the adaptive filter adjusts its output depending on the character of an error signal to produce a canceling sound from a speaker that is nearly equal in amplitude to and 180° out of phase with the source sound. Each of these systems requires a significant and somewhat complex apparatus in the form of microphones, loudspeakers and related electronics equipment. To operate effectively the apparatus must introduce appropriate delays between the receipt of a signal and the transmission of the canceling signal in order to take into account the speed with which the sound travels along a duct.

The use of these systems tends to be limited to applications where the location of the noise source and the direction of sound travel are confined. They do not operate effectively, for example, to reduce echoes emanating from a tank wall particularly where the direction of the acoustic energy is not known and echoes tend to scatter in all directions. A popular solution is the application of a passive, sound absorbing coating to the tank wall. Alberich coatings that consist of air voids in a rubber matrix are examples of such passive coatings. However, the passive coating must have a thickness that constitutes an appreciable fraction of the wavelength of the sound to be absorbed. Consequently, such coatings become impracticably thick at low acoustic frequencies, particularly below 1 kHz where wavelengths in water exceed 1.5 meters.

It has also been proposed to use a sound absorbing coating or layer comprising a layer of piezoelectric transducers. Such coatings are thin and convert a portion of incoming acoustic energy into electrical energy for dissipation in a resistive load. However, piezoelectric transducers are essentially resonant devices. Consequently, the outputs are frequency dependent and effective only over a narrow frequency range.

As an alternative to a single piezoelectric layer, it has been proposed to use two piezoelectric layers or skins in which a first layer acts as a receiver and an active control system drives the second layer to cancel the impinging sound. Although this approach can be effective, it requires the cost of two layers and an active control system with sufficient power to drive the second layer. This can become particularly burdensome and expensive if a large tank wall area is to be modified.

Various problems introduced by the capacitance characteristics of a piezoelectric transducer are recognized in the prior art. The following patents, for example, disclose various circuits for connection to piezoelectric transducers:

| | | |
|---|---|---|
| 3,390,286 | (1968) | Gradin et al |
| 3,400,284 | (1968) | Elazar |
| 4,816,713 | (1989) | Change |

Gradin et al discuss the effects of external capacitance and loads on piezoelectric transducers. They discuss a number of approaches for minimizing the sensitivity of an output signal to transducer capacitance and field effects outside the transducer. More specifically, Gradin et al disclose a temperature compensating capacitor in parallel with a piezoelectric transducer. This capacitor compensates any temperature variations in the piezoelectric transducer capacitance. A low pass filter and an impedance matching network minimize the adverse impact of a load on the transducer.

The Elazar patent discloses a piezoelectric transducer. It includes a temperature dependent capacitor in parallel with the piezoelectric element as a compensating component.

Change discloses a piezoelectric transducer with an electrical feedback circuit for canceling the capacitance of piezoelectric transducers and for increasing voltage gain with a minimal increase in noise levels. A field effect transistor amplifier has a gate connected to one transducer output terminal and a source electrode connected to the other transducer output terminal. Change represents the piezoelectric transducer by a lumped internal crystal capacitance and a stray capacitance. Charges generated by inertia forces on the transducer produce signals that effectively cancel the crystal capacitance by virtue of the use of two capacitors corresponding to the stray capacitance and the inter-electrode capacitance of a field effect transistor amplifier. However, the compensation and gain are dependent.

SUMMARY OF THE INVENTION

Therefore it is an object of this invention to provide a structure for modifying the acoustic reflection characteristics of an object such as a tank wall.

Another object of this invention is to provide a structure for absorbing acoustic energy that is effective over a wide frequency band.

Still another object of this invention is to provide a piezoelectric sound absorption layer that is adapted for application to surfaces having large areas.

Still yet another object of this invention is to provide a piezoelectric structure that can act as a sound absorber and can also be utilized as a sound projector or sound receiver.

Yet another object of this invention is to provide a circuit for electronically canceling any reactive current components produced by the transducer.

Yet still another object of this invention is to provide a circuit for electronically canceling any reactive signal components in a transducer output due to internal capacitance or other reactance.

In accordance with one aspect of this invention, apparatus for absorbing acoustic energy includes a piezoelectric layer disposed on the surface of a body intermediate the body and the source. A signal compensating circuit connects to the piezoelectric layer and generates a compensating current so the incoming sound is absorbed by the layer. The circuit includes an input means including a reactive element that has a value determined by the characteristic reactance of the piezoelectric layer. A current generator responds to a voltage across the reactive element by producing a compensating current that corresponds to the current from a reactive element having a negative reactive value. Consequently most of the acoustic energy can be absorbed by dissipation in a resistive load.

In accordance with another aspect of this invention, a reactive signal from an analog circuit having a predetermined reactance characteristic is compensated by generating a compensating current for being summed with the signal from the analog circuit. The compensating signal is derived by coupling the signal from the analog circuit through an input circuit that includes a reactive element that corresponds to the predetermined reactive characteristics and a current generator that responds to the voltage across the reactive element by generating the compensating current.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
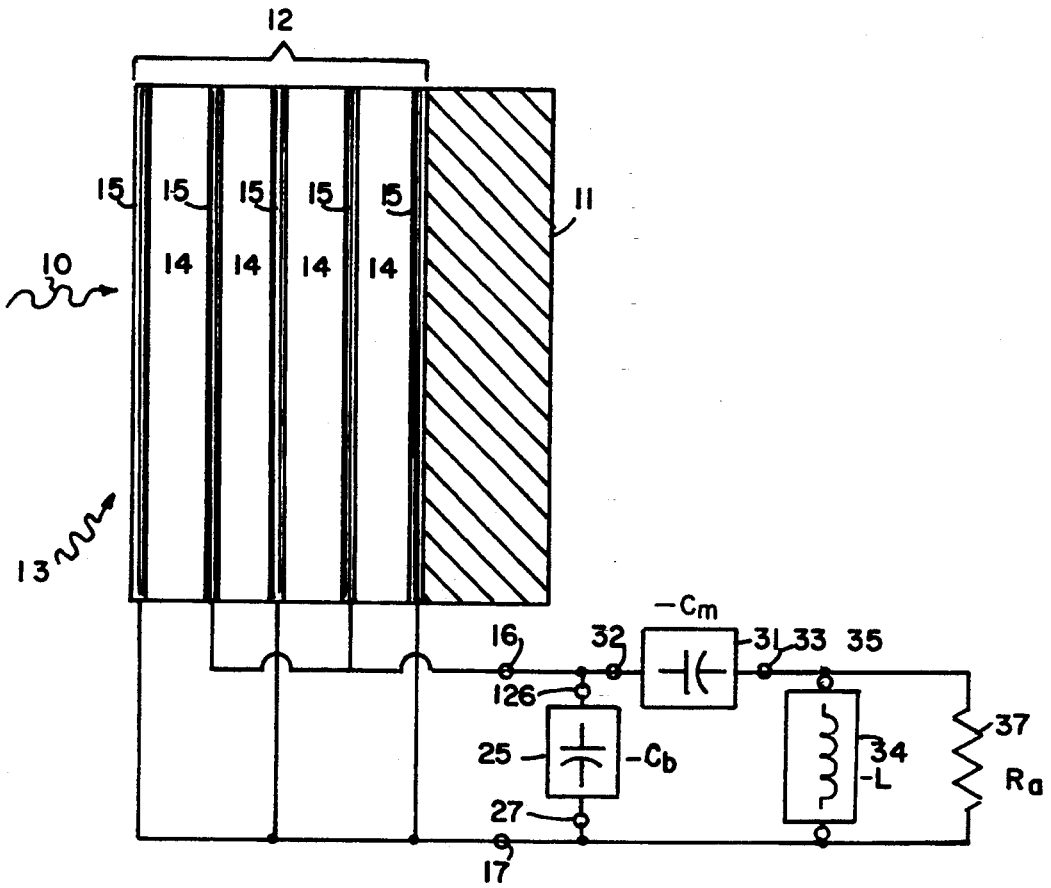
FIG. 1 is a diagram partially in schematic form that depicts apparatus embodying this invention.
Figure 2:
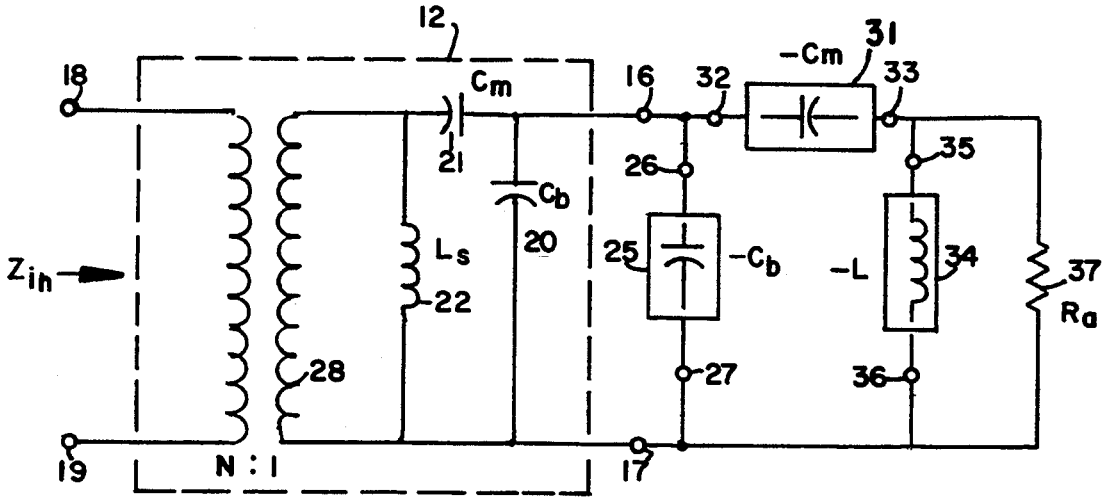
FIG. 2 is a schematic of the apparatus shown in FIG. 1.

FIG. 1 depicts acoustic energy in the form of a sound wave 10 approaching a wall segment 11 that has a finite mass. The wall 11, for example, might be constituted by an underwater acoustic test tank. In accordance with this invention a coating in the form of a piezoelectric transducer 12 is intermediate the wall 11 and the source of the sound wave 10. If the wall segment is part of a large area, plural piezoelectric transducers 12 and associated apparatus as shown in FIGS. 1 and 2 can be located at discrete, contiguous positions on the wall in an array.

As shown in FIG. 1, the piezoelectric transducer 12 comprises a plurality of polyvinylidene fluoride (PVDF) or other piezoelectric layers laminated between electrodes 15. Electrodes 15 are connected to a first terminal 16 and a second terminal 17, as well known in the art. The piezoelectric transducer 12 as shown in FIG. 1 is thereby disposed on the surface of a reflective body constituted by the tank wall 11 and is intermediate the body and the source of the acoustic energy represented by the waves 10 and 13.

Each transducer will be anechoic if it presents a mechanical impedance, defined as the ratio of normal components of force and velocity to the sound wave of $$\frac{\rho c A}{\cos\Theta} \tag{1}$$

where $\rho$ is the density of the medium, c is the speed of sound in the medium, A is the transducer area, and $\Theta$ is the angle of incidence.

FIG. 2 discloses a lumped-component equivalent circuit of the piezoelectric transducer 12 in the environment shown in FIG. 1. These lumped-components include a capacitor 20 representing "blocked capacitance" and having a value "$C_b$" and a capacitor 21 representing "motional capacitance" and having a value "$C_m$". As used herein, "blocked capacitance" is the capacitance that exists under blocked or clamped mechanical boundary conditions. "Motional capacitance" is the portion of the capacitance that arises from mechanical motion. Moreover, when piezoelectric transducers are attached to a wall, the mass and compliance of the wall can also impact the amplitude of any echo. This mass is represented in FIG. 2 by an inductor 22 having a value "$L_s$" that is directly proportional to the mass of the wall. If the wall is reasonably rigid, the mass of the wall can be disregarded as $L_s$ w $\infty$. The transducer can be further considered as including an electromechanical transformer 28 of turns ratio N Newtons per volt and presenting an mechanical impedance, $Z_{in}$, at terminals 18 and 19. "N" can further be defined as $$N = h_{33} C_b \tag{2}$$

where $h_{33}$ is a piezoelectric constant of the material in the transducer 12.

Without compensation the piezoelectric transducer 12 in FIG. 2 produces an electrical output signal at the terminals 16 and 17 that has several reactance components produced by the capacitors 20 and 21 and the inductor 22. Consequently the electrical signal produced by the piezoelectric coating is strongly frequency dependent, and the use of such transducers tends to be effective only at a narrow range of frequencies where all reactances essentially cancel and the signal has essentially no net reactive component. In such a range of frequencies, the selection of a value for a resistor $R_{load}$ is, $$R_{load} = \frac{\rho c A}{N^2 \cos\theta} \tag{3}$$

and the mechanical impedance becomes $$Z_{in} = \frac{\rho c A}{\cos\theta} \tag{4}$$

so, as described with reference to Eq. (1), an anechoic condition exists.

In accordance with this invention, a compensating network attaches to the terminals 16 and 17 to offset each of these reactive components over a wide frequency range by producing an offsetting component having "negative" reactive characteristics. More specifically, the terminals 16 and 17 shown in FIGS. 1 and 2, connect to three reactance compensating circuits. A blocked capacitance compensating circuit 25 behaves as a capacitor having a value $-C_b$ that corresponds in magnitude to the inherent blocked capacitance $C_b$ of the transducer 12. Its terminals 26 and 27 connect to the output terminals 16 and 17 respectively. Similarly, a motional capacitance compensating circuit 31 behaves as a capacitor having a value $-C_m$ that corresponds in magnitude to the inherent motional capacitance $C_m$ of the transducer 12. Its terminal 32 connects to the output terminal 16. Its terminal 33 connects to an optional wall mass compensating circuit 34 that having a value $-L_s$ that corresponds in magnitude to the mass $L_s$ of the supporting wall 11. A terminal 35 connects to terminal 33 and a terminal 36 connects to output terminal 17. If the wall 11 is rigid, then the wall mass compensating circuit 34 can be omitted. A resistive load means in the form of a resistor 37 having a value $R_{load}$ connects to the terminals 33 and 35 and to the terminals 17, 27 and 36.

Both an empirical and rigorous analysis of the circuit shown in FIG. 2 demonstrate that the signal applied to the resistor 37 contains no reactive current component due to the blocked capacitance 20 as the blocked capacitance with its value $C_b$ is effectively in parallel with the blocked capacitance compensating circuit 25 with its value of $-C_b$. Similarly the motional capacitance compensating circuit 31 with its value $-C_m$ compensates the motional capacitance 21 with its value $C_m$. If the equivalent inductance 22 of the supporting wall 11 becomes significant, the wall mass compensating circuit 34 produces an offsetting current with respect to that of the reactance of the inductance 22. Further, the operation of the entire circuit in FIG. 2 is independent of any frequency dependent term, so the circuit in FIG. 2 is effective over a wide range of frequencies, particularly at the acoustic energy band.

Figure 3:
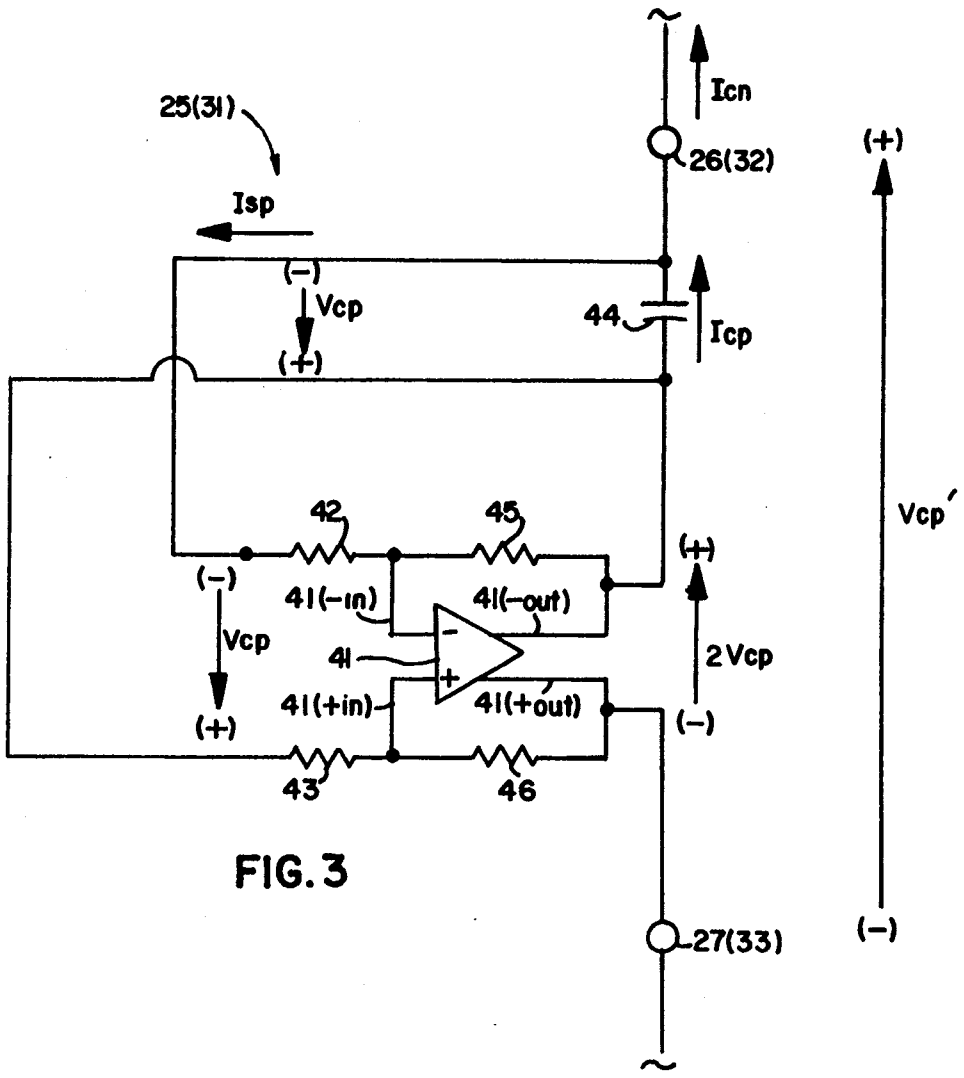
FIG. 3 is a schematic of a circuit that is useful in the apparatus shown in FIGS. 1 and 2.

FIG. 3 depicts a particular circuit embodiment that can function either as the blocked capacitance compensating circuit 25 or the motional capacitance compensating circuit 31 in FIGS. 1 and 2. For that reason in FIG. 3 the circuit is designated as circuit 25(31) and the terminals are designated as 26(32) and 27(33). When substituted for the circuits 25 and 33 in FIG. 2 the circuit of FIG. 3 will act as a capacitor having a value of $-C_b$ or as a capacitor having a value of $-C_m$.

The circuit 25(31) includes a conventional differential input, differential output amplifier 41 having input terminals 41(+in) and 41(−in) and output terminals 41(+out) and 41(−out). A resistor 42 interconnects the terminals 26(32) and 41(−in). A series resistor 43 and capacitor 44 connect the terminal 41(+in) to the terminal 26(32). The terminal 41(+out) connects to the junction of the resistor 43 and capacitor 44. A feedback resistor 45 interconnects the terminals 41(−in) and 41(−out). An output terminal 41(−out) connects to the terminal 27(33) and another feedback resistor 46 interconnects the terminal 41(+in) and a second output terminal 41(+out).

For this application the values of the resistors are given by $$R_{43}=R_{42} \tag{5}$$

and $$R_{45}=R_{46}=2R_{42} \tag{6}$$

Under these conditions the amplifier 41 has a gain of 2. The value of the resistors is also selected so $R_{42}$ is larger with respect to the reactance of the capacitor 44 (i.e., $C_{44}$) at the lowest operating frequency ($\omega_{min}$), i.e., $$R_{42} >> \frac{1}{j\omega_{min}C_{44}} \tag{7}$$

The value of the capacitor 44 is selected to match the value to be compensated. Thus if the circuit in FIG. 3 is to compensate motional capacitance, $C_{40}=C_m$. If the circuit in FIG. 3 is to compensate blocked capacitance, $C_{40}=C_b$.

When these conditions are met, a sensed input current, $I_{sp}$, coupled through the resistor 42 is negligible. Consequently the current leaving the mode at terminal 26(32), $I_{cn}$, is essentially equal to a net current $I_{cp}$ through the capacitor 44. Further, the voltage $V_{cp}$ is coupled to the amplifier 41 in a positive sense, so the amplifier 41 produces a voltage 2 $V_{cp}$ across its output terminals 41(−out) and 41(+out). As the polarity of this voltage is opposite to the polarity of the voltage $V_{cp}$, the net value of the voltage, $V_{cp}$, between the terminals 26(32) and 27(33) is the algebraic sum of the two voltages, so $$V_{cp}=V_{26}-V_{27}=-V_{cp}+2V_{cp}. \tag{8}$$

Consequently the voltage across the terminals 26(32) and 27(33) has the same value as the voltage produced by the capacitor 44 and the current has the same value as $I_{cn}$, but flows out of the node, or terminals 26(32) and 27(33). The two-terminal network of FIG. 3 therefore acts as a negative capacitance, i.e., a capacitor having a value $-Cp$, and constitutes a current generating means that responds to an input voltage provided by an input circuit means including the capacitor 44.

Figure 4:
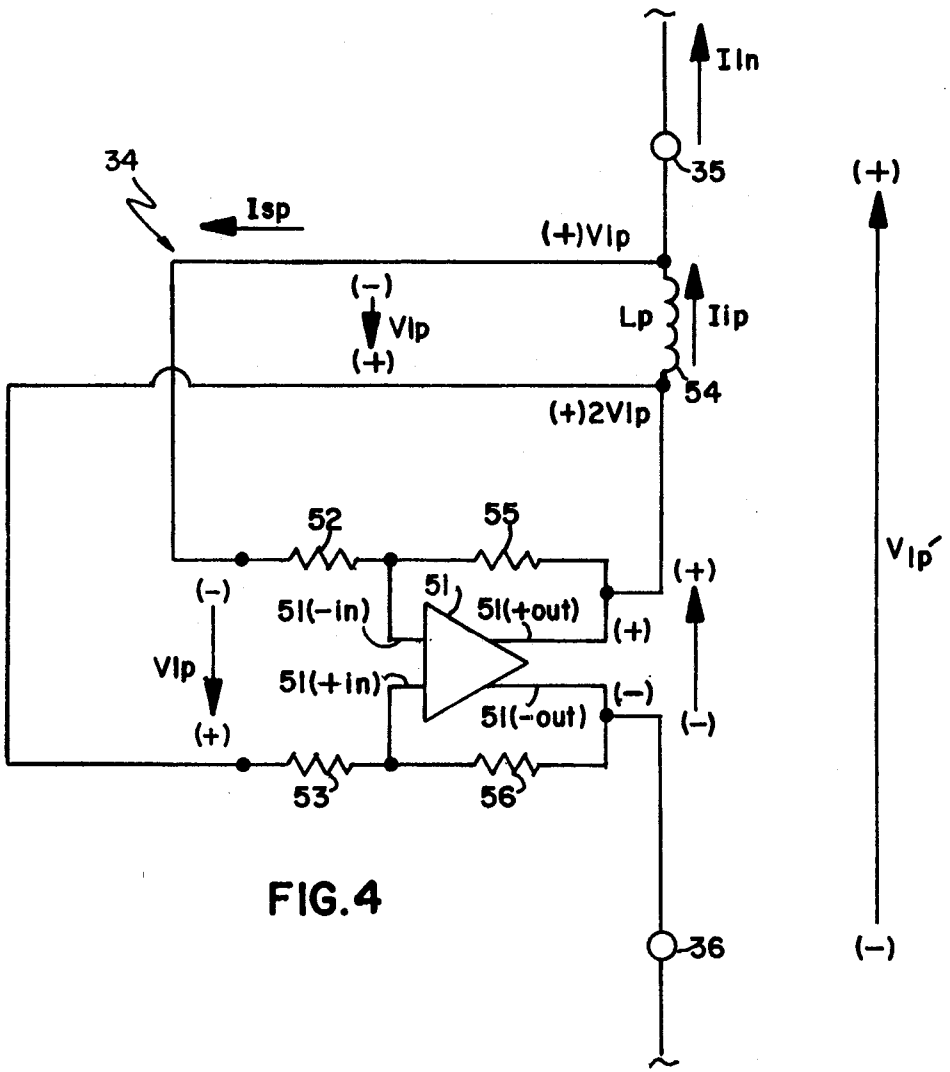
FIG. 4 is a circuit that is useful in the apparatus shown in FIGS. 1 and 2.

FIG. 4 is an adaption of the circuit of FIG. 3 that functions as a wall mass compensating circuit and that operates as a negative inductance. That is, when substituted for the circuit 34 in FIG. 2, the circuit of FIG. 4 will act as an inductor having a value $-L$. The circuit 34 includes a conventional differential input, differential output amplifier 51 having terminals 51(+in) and 51(−in) and output terminals 51(+out) and 51(−out). A resistor 42 interconnects the terminals 35 and 51(−in). A series resistor 53 and inductor 54 connect the terminal 51(+in) to the terminal 35. The terminal 51(+out) connects to the junction of the resistor 53 and the inductor 54. A feedback resistor 55 interconnects the terminals 51(−in) and 51(+out). The output terminal 51(−out) connects to the terminal 36, and another feedback resistor 56 interconnects the terminals 51(+in) and 51(−out).

For this application the values of the resistors are given by $$R_{53}=R_{52} \tag{9}$$

and $$R_{55}=R_{56}=2R_{52} \tag{10}$$

Under these conditions the amplifier 51 has a gain of 2. The value of the resistors is also selected to $R_{52}$ is large with respect to the reactance of the inductor 54 ($L_{54}$) at the highest operating frequency ($\omega_{max}$); i.e., $$R_{52} >> j\omega_{max}L_{54} \quad (11)$$

The value of the inductor 54 is selected to match the value to be compensated. Thus if the circuit in FIG. 4 is to compensate wall mass that exhibits the characteristic of an inductance $L_s$, then $L_{54}=L_s$.

When these conditions are met, a sensed input current, $I_{sp}$, coupled through the resistor 52 is negligible. Consequently the current leaving the node at terminal 35, $I_{ln}$, is essentially equal to a net current $I_{lp}$ through the inductor 54. Further, the voltage $V_{lp}$ is coupled to the amplifier 51 in a positive sense so the amplifier 51 produces a voltage $2V_{lp}$ across its output terminals 51(−out) and 51(+out). As the polarity of this voltage is opposite to the polarity of the voltage $V_{lp}$, the net value of the voltage between the terminals 36 and 35 is the algebraic sum of the two voltages, so $$V_{lp}=V_{35}-V_{36}=-V_{lp}+2V_{lp}. \quad (12)$$

Consequently the voltage across the terminals 35 and 36 has the same value as the voltage produced by the inductor 54 and the current has the same value as $I_{lp}$, but flows out of the node, or terminals 35 and 36. The two-terminal network of FIG. 4 therefore acts as a negative inductor i.e., an inductor having a value −L, and constitutes a current generating means that responds to an input voltage provided by an input circuit means including the inductor 54.

Figure 5:
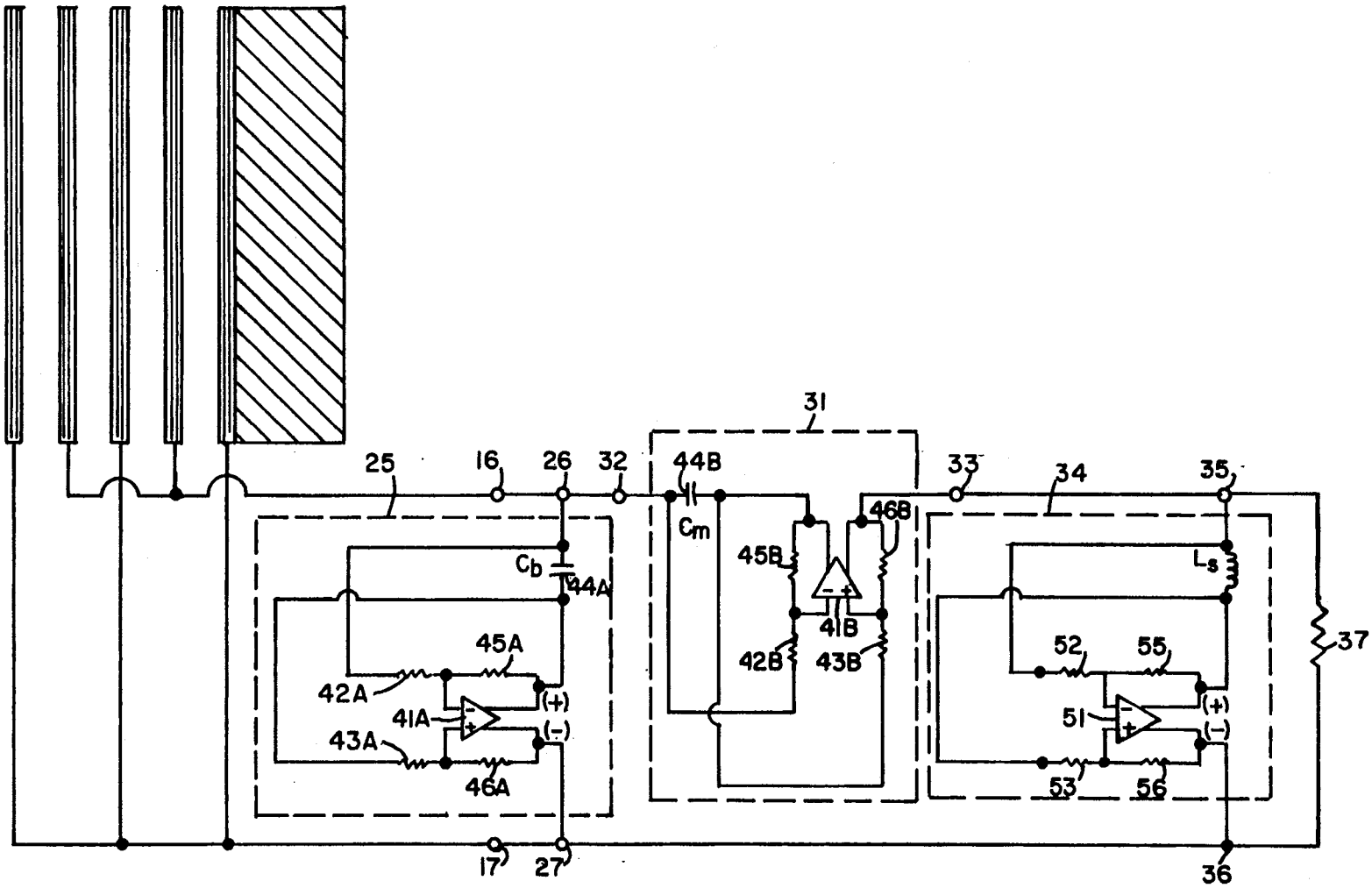
FIG. 5 is a specific embodiment of sound absorbing apparatus in accordance with this invention.

FIG. 5 depicts the use of the circuits of FIGS. 3 and 4 in the block diagrams of FIGS. 1 and 2. Specifically, the terminals 26 and 27 of the blocked capacitance compensating circuit 25 connect to the output terminals 16 and 17 respectively. The terminal 32 of the motional capacitance compensating circuit 31 connects to the terminals 16 and 26 and the terminal 33 connects to the resistor 37 and to the terminal 35 of the inductance compensating circuit 34 that is in parallel with the resistor 37. The terminal 36 connects to terminals 17 and 27.

In FIG. 5 the circuitry of FIG. 3 is duplicated and the suffix "A" identifies circuitry in the blocked capacitance compensating circuit 25 and the suffix "B" components used in the motional capacitance compensating circuit 31. The blocked capacitance compensating circuit 25 therefore includes a capacitor 44A having a value $C_b$ that serves as a positive reference capacitance to the operational amplifier 41A and gain-setting resistors 45A and 46A and input resistors 42A and 43A. Similarly the motional capacitance compensating circuit 31 includes a capacitor 44B having a value $C_m$ in an input circuit to an operational amplifier 41B with input resistors 42B and 43B and gain-setting resistors 45B and 46B.

If the tank wall 11 is not sufficiently rigid and there is a significant inductive reactance component, the inductance compensating circuit 34 is included. It comprises the inductor 54 having a value $L_s$. This inductor serves as a positive reference inductance to the operational amplifier 51 with its input resistors 52 and 53 and its gain-setting resistors 55 and 56.

Each of the compensating circuits shown in FIGS. 3 and 4 essentially produces offsetting compensating signals that are out of phase with any corresponding reactance component in a signal applied to the compensating circuit. In the specific application shown in FIGS. 1, 2 and 5, the compensating circuits 25, 31 and 34 collectively; act to cancel any reactive, or imaginary, current components. When the resistor 37 is selected according to Eq. (3), it will dissipate energy associated with the remaining, or real, current component.

When the circuit components of FIG. 5 are selected in accordance with these criteria, the system of FIG. 5 presents a mechanical impedance $$\frac{\rho cA}{\cos\theta} \quad (13)$$

where "ρc" is the characteristic resistance of the medium to minimize signal reflections. Consequently, essentially no acoustic energy reflects from the transducer 12 or wall 11 and no echo is generated.

Viewed differently, the structure in FIGS. 1, 2 and 5 can be considered as a single piezoelectric layer that acts as a receiver, generates a signal that causes the various compensating circuits 25, 31 and 34 to drive the piezoelectric layer 12 as a sound generator with the correct amplitude and phase to cause sound cancellation. As the relative time delays through the circuitry are insignificant with respect to the frequency of the acoustic waves, all the compensating actions occur essentially instantaneously. Therefore, it can be considered that any reactive component will produce an offsetting or compensating signal instantaneously.

In summary, therefore, a wall segment 11 shown in FIG. 1 has a piezoelectric layer 12 formed intermediate the wall segment 11 and a source of acoustic energy represented by sound waves 10 and 13. The disclosed apparatus absorbs incoming sound by converting any reactive or imaginary current components into real current thereby to enable a resistive load to dissipate the acoustic energy. This system can also be considered as a combination if receiver and projector or as either a receiver or a projector. FIG. 1 discloses a simultaneous use as a receiver and projector. Alternatively, the terminals 16 and 17 could be disconnected from the circuitry shown in FIG. 1 and reconnected to a receiver or a transmitter in order to produce a signal in response to or to generate an acoustic field from the transducer 12.

In an application as a sound absorber, the layer of piezoelectric devices attached to the wall is much thinner than an anechoic material coating that achieves the same level of absorption. The apparatus of this invention also is significantly less complex than apparatus incorporating separate receiver and transmitting piezoelectric layers. Moreover, the entire system is readily adapted for treating large areas merely by placing multiple transducers in an array over a large surface with each transducer being constructed as shown in FIGS. 1 through 5.

This invention has been disclosed in terms of certain embodiments. It will be apparent that many modifications can be made to the disclosed apparatus without departing from the invention. For example, different circuit arrangements might be used to implement the specifically disclosed compensating circuits. Each compensating circuit is shown with independent terminals for purposes of discussion. In practice the circuits could be implemented without separate or distinct terminals. Therefore, it is the intent of the appended claims to cover all such variations and modifications as come within the true spirit and scope of this invention.

What is claimed is:

1. In an analog circuit having a reactive element of a predetermined value that generates a reactive signal component at output terminals thereof, signal compensation means for producing a signal component that offsets the reactive signal component comprising:

a compensating reactive element having electrical characteristics that correspond to those of the reactive element in the analog circuit;

amplifier means having differential input and differential output terminals, one of said amplifier output terminals being connected to one of the analog circuit output terminals and the other of said amplifier output terminals being connected through said compensating reactive element to the other of said analog circuit output terminals; and input circuit means for coupling the voltage across said compensating reactive element to said differential input terminals whereby said signal compensation means exhibits the characteristics of a reactive element having a value equal to the negative of the predetermined value.

2. Signal compensation means as recited in claim 1 wherein said input means includes first and second resistive means for inverting the signal from reactance.

3. Signal compensation means as recited in claim 2 wherein the reactive element in the analog circuit is a capacitive element of value C and said compensating reactive element comprises a capacitor having a value $C_P$ that depends upon the value C whereby said signal compensation circuit exhibits the characteristics of a reactance having a value of $-C$.

4. Signal compensation means as recited in claim 2 wherein the reactive element in the analog circuit is an inductive element of value L and said compensating reactive element comprises an inductor having a value $L_P$ that depends upon the value L whereby said signal compensation circuit exhibits the characteristics of a reactance having a value of $-L$.

5. Signal compensation means as recited in claim 2 wherein said amplifier means includes an operational amplifier having inverting and non-inverting inputs and outputs and input resistors in series with each of said inputs, said resistors connecting to said compensating reactive element and to said output terminals.

6. Signal compensation means as recited in claim 5 wherein said amplifier means additionally includes resistive feedback means interconnecting said inverting inputs and outputs of said operational amplifier means.

7. Signal compensation means as recited in claim 6 wherein the reactive element in the analog circuit is a capacitive element of value C and said compensating reactive element comprises a capacitor having a value $C_P$ that depends upon the value C whereby said signal compensation circuit exhibits the characteristics of a reactance having a value of $-C$.

8. Signal compensation means as recited in claim 6 wherein the reactive element in the analog circuit is an inductive element of value L and said compensating reactive element comprises an inductor having a value $L_P$ that depends upon the value L whereby said signal compensation circuit exhibits the characteristics of a reactance having a value of $-L$.

9. Signal compensation means as recited in claim 1 wherein said amplifier means comprises operational amplifier means having inverting and non-inverting inputs and outputs and input circuit means includes input resistors in series with each of said inputs, said input resistors connecting to said compensating reactive element.

10. Signal compensation means as recited in claim 9 wherein said amplifier means additionally includes resistive feedback means interconnecting said inputs and outputs of said operational amplifier means.

11. Signal compensation means as recited in claim 10 wherein the reactive element in the analog circuit is a capacitive element of value C and said compensating reactive element comprises a capacitor having a value $C_P$ that depends upon the value C whereby said signal compensation circuit exhibits the characteristics of a reactance having a value of $-C$.

12. Signal compensation means as recited in claim 10 wherein the reactive element in the analog circuit is an inductive element of value L and said compensating reactive element comprises an inductor having a value $L_P$ that depends upon the value L whereby said signal compensation circuit exhibits the characteristics of a reactance having a value of $-L$.

13. Apparatus for absorbing acoustic energy from a source directed toward the surface of a sound reflection member comprising:

piezoelectric means disposed on the surface of the reflection mender intermediate the surface and the source for generating at output terminals thereof an electrical signal having a reactive signal component due to the characteristics of said piezoelectric means;

signal compensation means connected to the output terminals including current generating means for generating at an output thereof a compensating current to be summed with the current from said piezoelectric means in response to signals at an input of said current generating means, a compensating reactance element having a value corresponding to the characteristic reactance and being in series with said current generating means output, and signal inverting means for coupling the signal across said compensating reactance to said current generating means; and power dissipation means connected to said signal compensation means for dissipating any power produced by the impinging acoustic energy whereby said apparatus absorbs impinging acoustic energy from the source.

14. Apparatus as recited in claim 13 wherein the sound reflecting body has a large surface and said apparatus includes an array of piezoelectric means covering the surface, each said piezoelectric means including a said signal compensation means and a said power dissipation means.

15. Apparatus as recited in claim 13 wherein said piezoelectric means has a characteristic blocked capacitance $C_b$ and a motional capacitance $C_m$ and said signal compensation means includes:

a first current generator connected to the output terminals for generating a first compensating current at an output thereof, a first compensating reactance element including a first capacitor in series with said first current generator output having a value $C_1 = C_b$ and first signal inverting means for coupling the voltage across said first capacitor to first current generator; and a second current generator connected to the output terminals for generating a second compensating current at an output thereof and a second compensating reactance including a second capacitor in series with said second current generator output having a value $C_2 = C_m$ and second signal inverting means for coupling the voltage across said second capacitor to said second current generator whereby said first and second current generators compensate reactive signals due to the characteristic blocked and motional capacitances of said piezoelectric means.

16. Apparatus as recited in claim 15 wherein the sound reflective member has a characteristic mass represented as a motional inductance $L_m$ that introduces an inductive component into the signal from said piezoelectric means and wherein said apparatus includes a third current generator connected to the output terminals for generating a compensating current at an output thereof and a third compensating reactance including an inductor in series with said third current generator output having a value $L = L_m$ that corresponds to the mass of the reflective member and third signal inverting means for coupling the voltage across said inductor to said third current generator whereby said third current generator compensates reactive signals due to the mass of the reflective member wall.

* * * * *